US010363601B2

(12) United States Patent
Susalla et al.

(10) Patent No.: US 10,363,601 B2
(45) Date of Patent: Jul. 30, 2019

(54) METHOD FOR THERMAL CONTROL OF CAST-IN COMPONENTS DURING MANUFACTURING

(71) Applicant: Ford Global Technologies, LLC, Dearborn, MI (US)

(72) Inventors: Paul Christopher Susalla, South Lyon, MI (US); Ronald H. Hassenbusch, Grosse Pointe Park, MI (US)

(73) Assignee: Ford Motor Company, Dearborn, MI (US)

( * ) Notice: Subject to any disclaimer, the term of this patent is extended or adjusted under 35 U.S.C. 154(b) by 161 days.

(21) Appl. No.: 14/865,190

(22) Filed: Sep. 25, 2015

(65) Prior Publication Data

US 2017/0087628 A1 Mar. 30, 2017

(51) Int. Cl.

| | |
|---|---|
| ***B22D 19/00*** | (2006.01) |
| ***B22C 9/02*** | (2006.01) |
| ***B22C 9/24*** | (2006.01) |
| ***B22D 21/04*** | (2006.01) |
| ***B22D 25/02*** | (2006.01) |

(52) U.S. Cl.

CPC ..... *B22D 19/00* (2013.01); *B22C 9/02* (2013.01); *B22C 9/24* (2013.01); *B22D 19/0009* (2013.01); *B22D 21/04* (2013.01); *B22D 25/02* (2013.01)

(58) Field of Classification Search

CPC ..... B22D 27/00; B22D 27/04; B22D 19/00; B22D 19/0027; B22C 9/00; B22C 9/02; B22C 9/06; B22C 9/065; B22C 9/10

See application file for complete search history.

(56) References Cited

U.S. PATENT DOCUMENTS

| | | | |
|---|---|---|---|
| 4,809,762 | A | 3/1989 | Ito et al. |
| 4,953,612 | A | 9/1990 | Sare et al. |
| 5,234,045 | A | 8/1993 | Cisko |

(Continued)

FOREIGN PATENT DOCUMENTS

| | | |
|---|---|---|
| EP | 0782895 | 7/1997 |
| JP | 58038564 | 3/1983 |

(Continued)

OTHER PUBLICATIONS

English machine translation of JPS60111754.*

*Primary Examiner* — Kevin P Kerns
*Assistant Examiner* — Steven S Ha
(74) *Attorney, Agent, or Firm* — LeClairRyan

(57) ABSTRACT

A method for forming a product having cast-in components provides an insulating barrier of solidified sand formed next to the insider diameter of the cast-in component. The center of the solidified sand is hollow. Before pouring the molten metal into the primary runner/riser system that feeds the portion of the mold that will create the actual part, the molten material is poured into the hollow portion of the solidified sand through a separate runner/riser system. This molten metal provides the energy necessary to heat the cast-in part to an acceptable temperature. The temperature can be controlled by the shape, thickness and material of the insulating member. This controlled time/temperature profile enables the creation of a final cast product that demonstrates good quality properties at the cast/insert interface. The method of the disclosed inventive concept has the added benefit of not altering the resulting part itself.

20 Claims, 4 Drawing Sheets

(56) References Cited

U.S. PATENT DOCUMENTS 5,365,997 A * 11/1994 Helgesen ..... B22D 19/0081
164/103
7,293,598 B2 11/2007 Bend

FOREIGN PATENT DOCUMENTS

| | | |
|---|---|---|
| JP | 58112649 | 7/1983 |
| JP | 58181464 | 10/1983 |
| JP | 60111754 | 6/1985 |
| JP | 61186156 | 8/1986 |

* cited by examiner

METHOD FOR THERMAL CONTROL OF CAST-IN COMPONENTS DURING MANUFACTURING

TECHNICAL FIELD

The disclosed inventive concept relates generally to a method of manufacturing an article from molten metal having a cast-in insert. More particularly, the disclosed inventive concept relates to a method of manufacturing an article such as an engine block having a cast-in insert by forming a hollow insulating barrier adjacent the cast-in part and pouring the molten metal into the hollow part of the insulating barrier to heat the cast-in part prior to formation of the block.

BACKGROUND OF THE INVENTION

The task of making cast-in components during the production of metal castings has challenged manufacturers since the earliest days of automotive manufacturing. For example, this challenge is particularly great in the manufacture of engine blocks having cast-in cylinder liners. Over time, manufacturers found that pre-heating the cast-in component resulted in a superior product.

The previous solutions to pre-heating cast-in components include both induction heating (when manufactured in high volumes) and designing a mold package in which the molten material is in direct contact with the cylinder liner. A dual runner (or riser) system is formed into the casting mold assembly. During the primary pour, the molten metal flows past the cast-in component in an attempt to heat it. In this way, the molten metal used to heat the liners is in direct contact with the insert.

However, when used in direct contact with the liner insert, there is little control of the heating time, the position of the molten metal, or the temperature profile of the insert. Particularly, the same metal that is trying to heat the component is also the metal that the manufacturer desires to stay at the pour temperature so that a quality casting is made. However, the act of heating the cast-in component cools the molten metal and may prematurely solidify it.

Additionally, that material solidifies and adheres to the insert requiring additional machining processes to remove. Depending on the shape of the insert, it may also not be possible to completely remove the heating material from the insert.

In summary, finding an economical and practical method of pre-heating cast-in inserts during manufacturing is a problem that remained unsolved until the present invention.

SUMMARY OF THE INVENTION

The method of the disclosed inventive concept for forming a product having cast-in components overcomes the challenges faced by known methods. According to the method disclosed herein, an insulating barrier of solidified sand is formed next to cast-in component. The barrier of solidified sand may be poured into an internal cavity, in the case of, for example, a cylinder, or may be poured in a cavity that surrounds the cast-in component, in the case of, for example, a crankshaft. The center of the solidified sand is hollow. Before pouring the molten metal into the primary runner/riser system that feeds the portion of the mold that will create the actual part, the molten material is poured into the hollow portion of the solidified sand through a separate runner/riser system. This molten metal provides the energy necessary to heat the cast-in part to an acceptable temperature. The temperature can be controlled by the shape, thickness and material of the insulating member. This controlled time/temperature profile enables the creation of a final cast product that demonstrates good quality properties at the cast/insert interface. The method of the disclosed inventive concept has the added benefit of not altering the resulting part itself.

By use of the solidified sand insulating barrier, the heating material is neither attached to nor becomes part of the final casting. After the precise time has passed to increase the cast-in component to the prescribed temperature, the molten metal is poured into the primary runner/riser system to feed the actual part that includes the cast-in component as formed by the mold.

The method of the disclosed inventive concept is flexible and highly adaptable to a broad variety of cast products. The method disclosed herein is compatible with low volume or high complexity applications since dedicated tooling for induction heating is not required. Even though the method disclosed herein is ideal down to "batch of one" applications, it can be used just as effectively for high volume production applications. Additionally, if additive manufacturing of the core package is utilized, there is essentially no additional cost for tooling.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
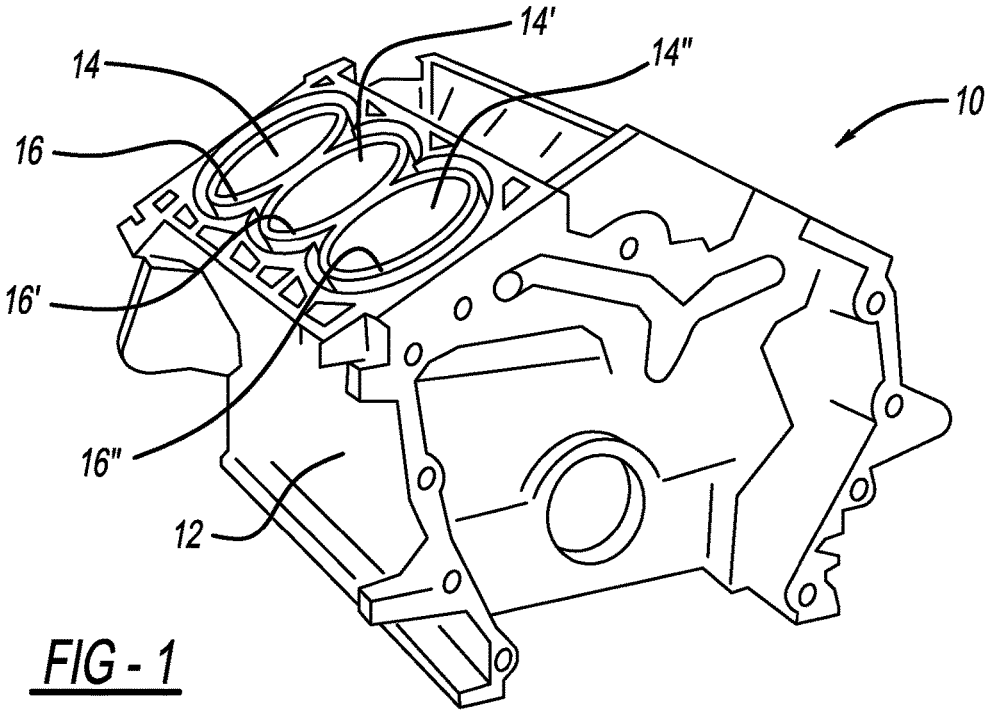
FIG. 1 is a perspective view of a cylinder block having cast-in liners post-production.

In the following figures, the same reference numerals will be used to refer to the same components. In the following description, various operating parameters and components are described for different constructed embodiments. These specific parameters and components are included as examples and are not meant to be limiting.

The method of the disclosed inventive concept for forming a cast article having cast-in components provides a solution to problems associated with currently-known techniques. Particularly, the method disclosed herein uses molten metal that is insulted from the inserts to be cast-in by way of a "tunable" insulating barrier. This arrangement creates a controlled pre-heating of the cast-in part. The method of the disclosed inventive concept results in tuned and controlled time/temperature profiles and controlled time/position/temperature profiles.

The method of the disclosed inventive concept may be used in the production of any cast part in which a cast-in component is present. The method thus offers significant advantages in the automotive industry. Accordingly, the following discussion and accompanying figures relate to the formation of an engine block for an internal combustion engine. However, it is to be understood that the disclosed specific embodiment is suggestive only and is not intended as being limiting. As to the engine block itself disclosed in the accompanying figures and discussed in conjunction therewith, the illustrated engine block is shown in the figures for suggestive purposes only as the overall configuration may be altered from that illustrated.

The method according to the disclosed inventive concept provides the following general steps. First, a mold package including a lower portion and an upper package having a part runner for the part to be cast and cavity runner for the pre-heating molten metal is formed. Second, the cast-in component, such as a cast iron cylinder liner, is positioned in the lower portion of the mold package. Third, a core formed from an insulating material is positioned substantially around the cast-in component. The core may be made from solidified sand and has a molten metal-receiving cavity formed therein. Fourth, a specific amount of a molten metal having a specific temperature is introduced into the cavity formed inside the insulating material through the secondary runner. The heat energy of the molten material travels through the solidified sand and into the cast-in component. Fifth, the upper portion of the mold package is placed over the lower portion. Sixth, once the cast-in component is at a proper temperature, the rest of the molten metal poured to create the part. Seventh, the mold is opened and the cast part is removed from the mold. Eighth, the metal inside the insulating material and the insulating material itself is removed from the cast part. The mold arrangement and the details of the general steps are set forth hereafter.

Referring to FIG. 1, a cylinder block having cast-in liners produced according to the method of the disclosed inventive concept is shown. The cylinder block, generally illustrated as 10, includes a block 12 having cylinders 14, 14' and 14" formed therein. Each of the cylinders 14, 14' and 14" includes a cast-in liner 16, 16' and 16" respectively. A like number of cylinders (not shown) are formed on the opposite side of the block 12. While a conventional V-6 engine is illustrated, as noted above, the method of the disclosed inventive concept may be applied to a block having any number of cylinders in any number of configurations and in any displacement.

Figure 2:
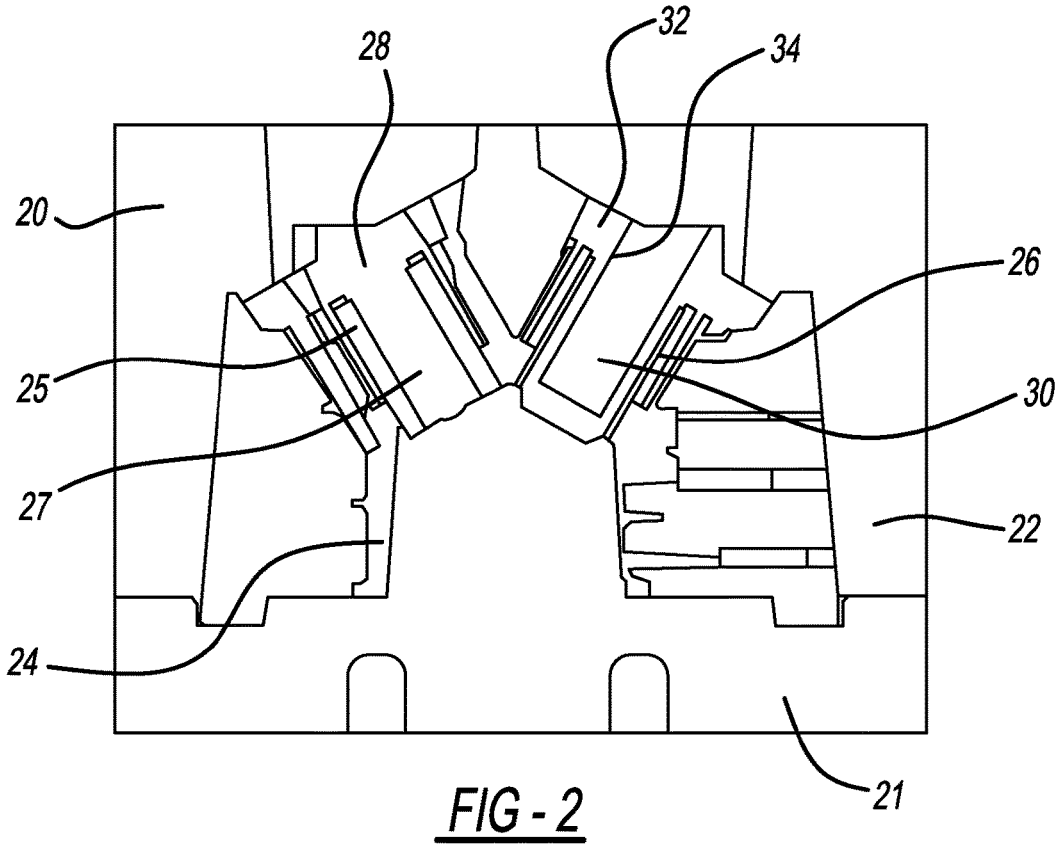
FIG. 2 is a cross-section of a cylinder block having cast-in liners after the sand has been inserted and hollowed out such that a chamber remains.

Referring to FIG. 2, and as noted above, a mold package 20 is formed for the part to be cast. The mold package 20 includes a lower portion 21 and an upper portion 22. Formed between the lower portion 21 and the upper portion 22 is a part cavity 24. A part runner (not shown) is fluidly connected to the part cavity 24. Into the mold package 20 have been fitted cast-in components. The cast-in components shown in FIG. 2 are cylinder liners 25 and 26.

Figure 3:
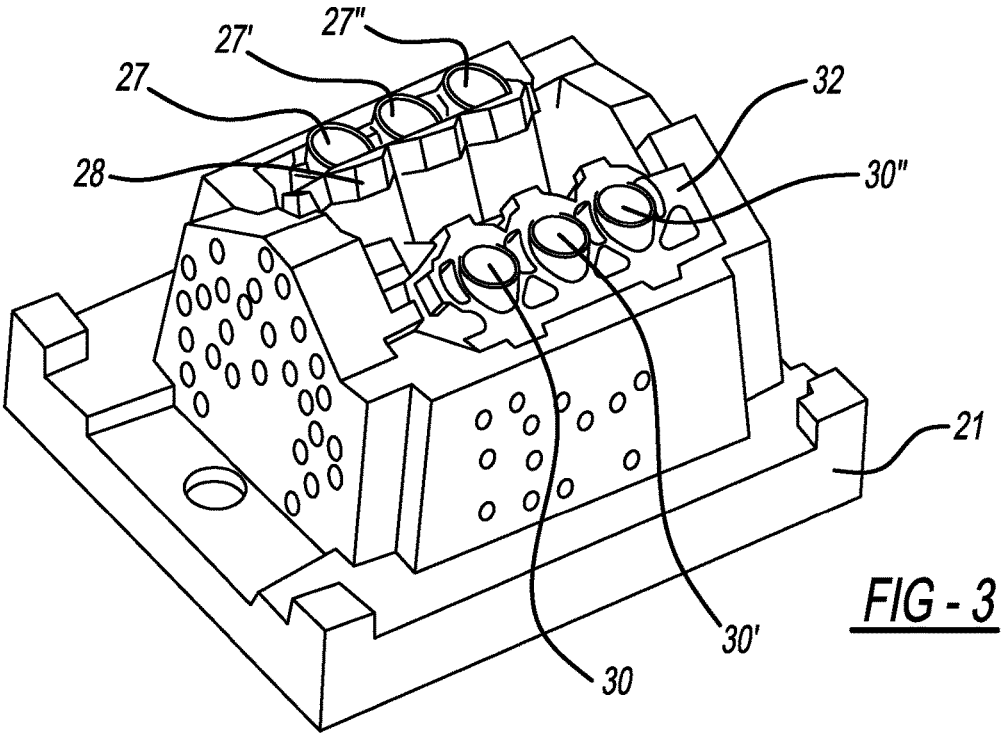
FIG. 3 illustrates a perspective view illustrating the lower half of the mold package with the insulating material formed in position around the cylinder liners.

Substantially around each cylinder liner is formed an insulating core from an insulating material. Preferably, but not exclusively, the insulating material may be printed sand or may be a pourable sand that is solidified once poured to take a specific shape. As shown in FIG. 3, a first bank of cylinders comprising cylinders 27, 27' and 27" are insulated using an insulating wall 28. A second bank of cylinders comprising cylinders 30, 30' and 30" are insulated using an insulating wall 32.

With the upper portion 22 of the mold package 20 in position on the lower portion 21 of the mold package 20 The arrangement of the insulating barrier 28 around the cylinder liner 25 and the arrangement of the insulating barrier 32 around the cylinder liner 26 are illustrated in FIG. 2. As illustrated in that figure, a molten metal-receiving cavity or chamber is formed within each core. Particularly, a molten metal-receiving cavity 34 is formed within the insulating core 32. It is to be understood that the thickness of the wall of the insulating core 32 as well as the shape of the cavity 34 formed in the core may both be varied as needed to adjust for true temperature control. At least one metal-receiving cavity runner (not shown) is formed integral with the mold.

Figure 4:
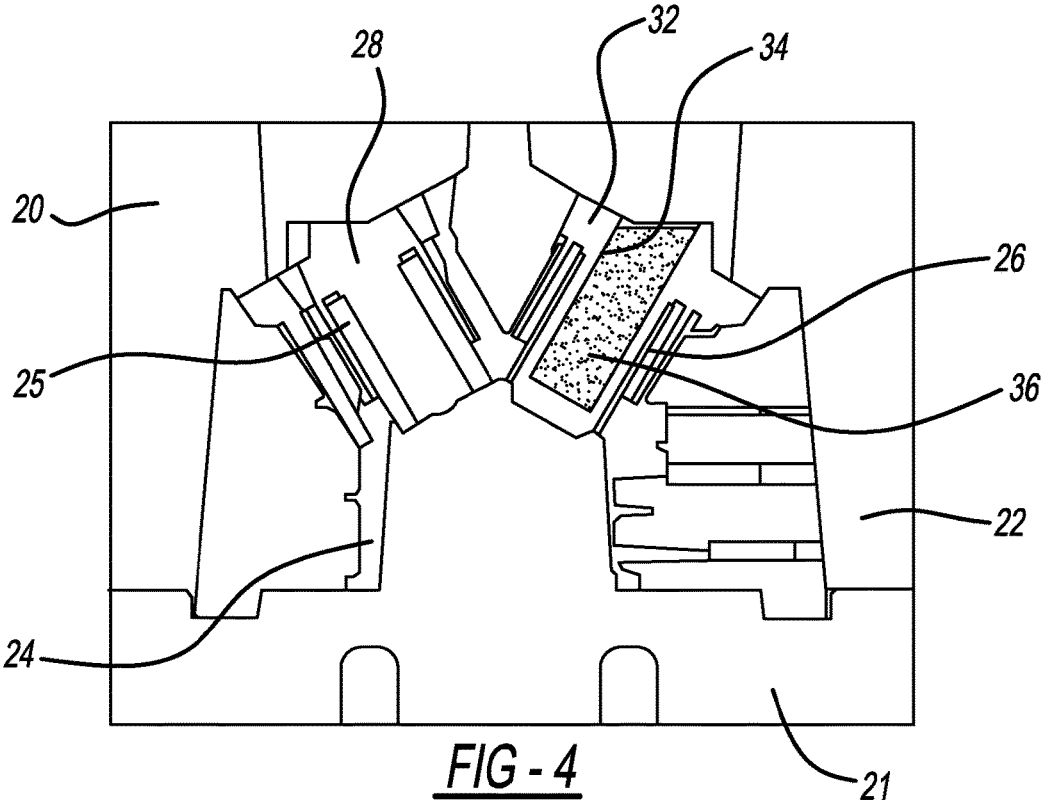
FIG. 4 is similar to FIG. 2, but the pre-heating pour of a molten metal has been made into the cavities formed in the sand.

The insulating sand is preformed by methods such as, but not limited to, 3D printing or through the use of conventional tooling prior to assembly in the mold. Once the insulating sand is in its desired position, a first portion of a molten metal 36 is poured into the cavities formed in the sand, including the illustrated molten metal-receiving cavity 34. This step of the procedure is illustrated in FIG. 4. The molten metal 36 is poured into the molten metal-receiving cavity 34 by way of the metal-receiving cavity runner. The heat energy of the molten metal 36 travels through the wall of the insulating core 32 and into the cylinder liner 26. The molten metal 36 may be selected from any of several metals, including, but not limited to, aluminum.

Figure 5:
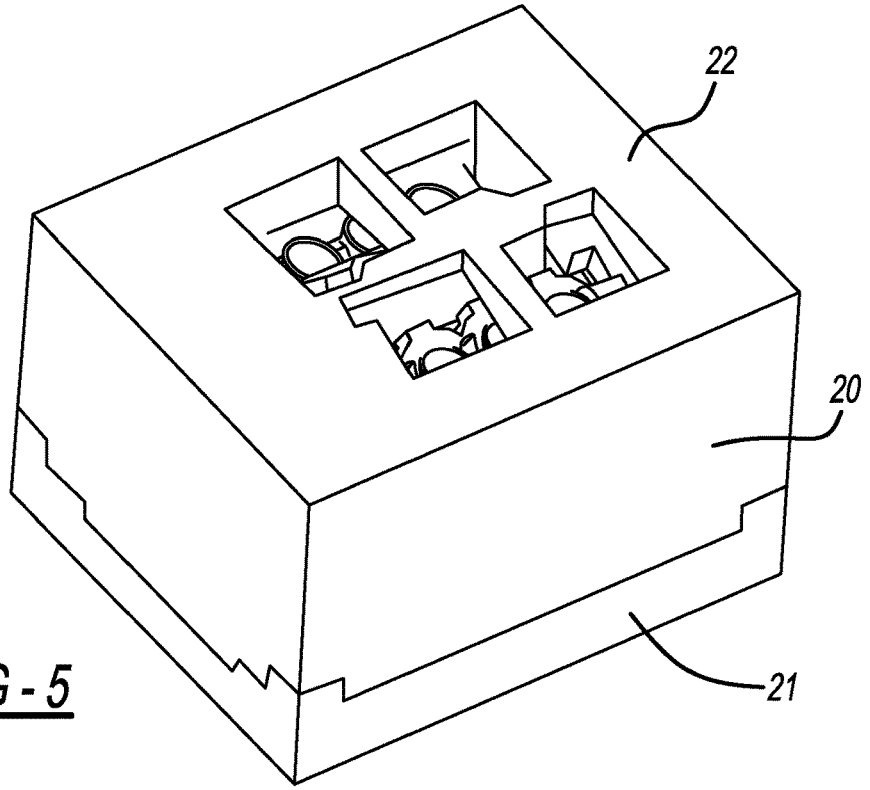
FIG. 5 illustrates a perspective view of the mold package having been closed with the upper part of the mold package in place in preparation to pour the remainder of the engine block.

With the upper portion 22 of the mold package 20 in position on the lower portion 21 of the mold package 20 as illustrated in FIG. 5, the molten metal 36 may be poured into the heating chambers. As an alternative, the pre-heated aluminum can be poured into the chambers to pre-heat the inserted iron liners before the upper portion 22 is placed in position on the lower portion 21. Following the pouring of the pre-heating aluminum, the upper portion 22 is fitted into position to form the complete mold package 20.

Figure 6:
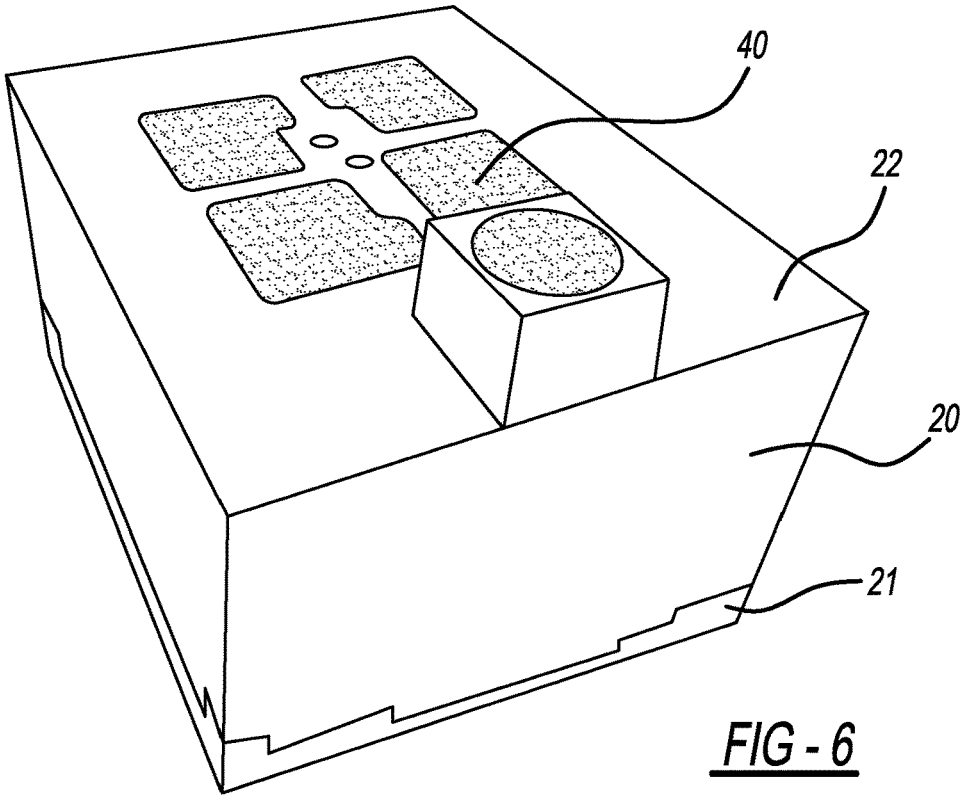
FIG. 6 illustrates a view similar to that of FIG. 5 but showing the remainder of the molten metal having been poured to form the block and to encapsulate the cast-in liners.
Figure 7:
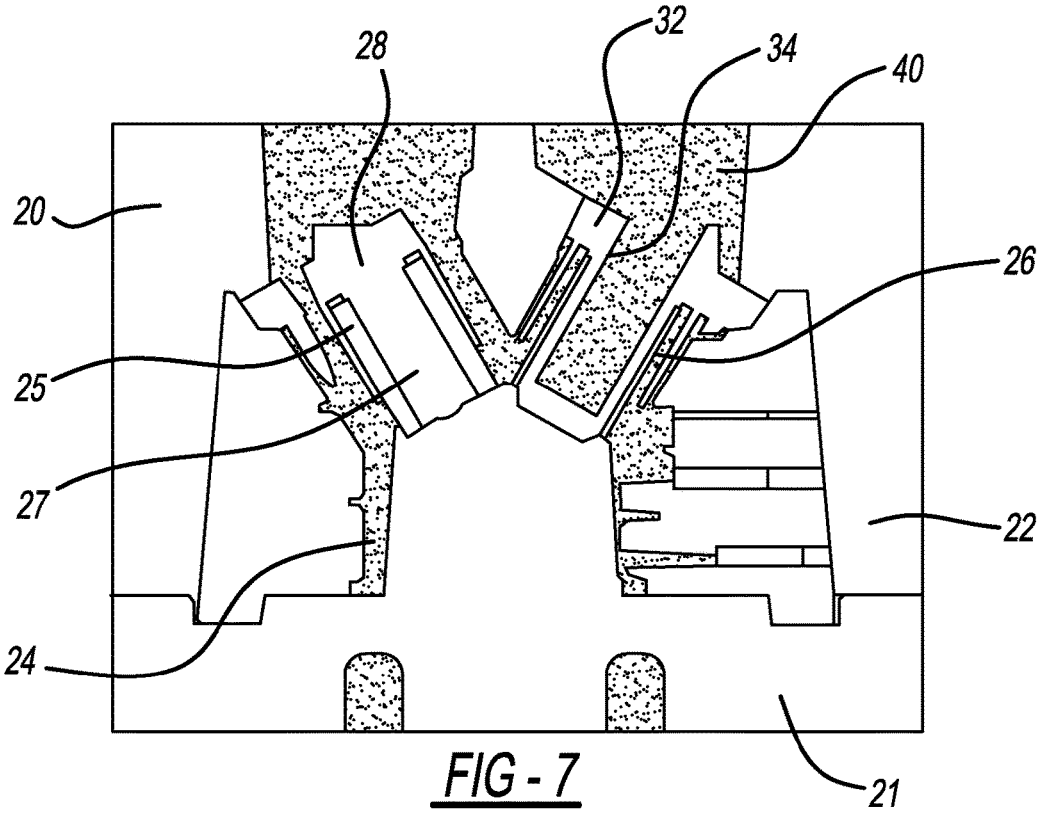
FIG. 7 is similar to FIG. 3, but illustrating the remainder of the molten metal having been poured according to the step shown in FIG. 6 to create the cylinder block.

After the complete mold package 20 is formed and after the liners achieve a desirable temperature by the presence of the molten metal 36, the elapsed time being generally in the range of between 10 and 20 minutes, additional molten metal 40 is poured into the mold through runners formed in the upper portion 22 of the mold package 20. This step is illustrated in FIG. 6 which shows a perspective view of the mold package 20 with the additional molten metal 40 poured into position. FIG. 7 illustrates the molten metal 40 filling the remaining voids around the cylinder liners 25 and 26 by which the liners are encapsulated. At this stage, the engine block 12 is formed from the molten metal 40.

Figure 8:
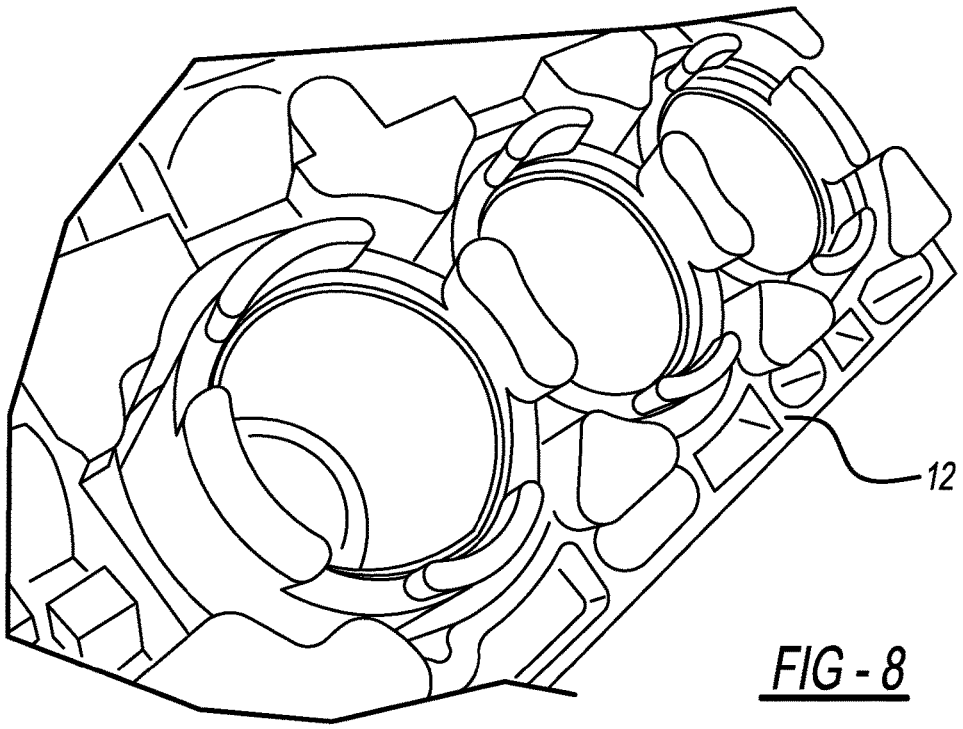
FIG. 8 is a perspective view of a portion of the cylinder block with the sand mold having been removed, together with the gates and risers.

In FIG. 8, a portion of the resulting cylinder block 12 is illustrated. In this view, the sand mold has been removed from the cast block 12. Other casting components, such as gates and risers (neither shown), have also been removed. The resulting cast block shows that the interface of the aluminum casting to the cast iron cylinder liners is free of voids and demonstrates exceptional adherence properties.

This outcome compares very favorably to the results obtained using prior techniques.

The method of the disclosed inventive concept can be fine-tuned to provide satisfactory results across a wide range of cast products requiring cast-in components. To reduce or eliminate overheating during the solidification process of the casting, certain adjustments can be made. For example, experimentation showed that the cast-in liners of the center cylinders overheated compared with adjacent cast-in liners. This is so because the center cast-in liners are surrounded on two sides by the cast-in liners that were being simultaneously heated. By increasing the thickness of the barrier walls of the center cylinder liners, the amount of energy transferred to the liners from the molten aluminum used to heat them was lowered. As an end result, all of the cast-in liners were able to be brought to the proper and consistent temperature prior to the pour and no overheating during the solidification process of the casting was detected.

The method of the disclosed inventive concept may be used in the manufacture of any cast product in which a cast-in component is used. In the automotive environment, and as noted above, the method has particular application in the formation of engine blocks. However, the method may also be used in the production of steel shafts in transmission supports, bi-metallic flywheels, and brake disks.

The method disclosed herein has significant cost-saving potential. In the automotive industry, for example, many manufacturers utilize cast-in liner blocks and other castings with dissimilar metal cast-in components. Prototyping of these components, and even high production applications, would benefit greatly from this method.

The disclosed inventive concept of pre-heating a cast-in component during the manufacturing process offers several advantages over known methods. One such advantage of the new method is that the heating of the cast-in component and the properties of the molten metal are completely separated. In fact, the temperature of the cast-in components can be controlled simply by the amount of time allowed between the pouring of the "heating" molten metal and the pouring of the "primary" molten metal. Thus the disclosed inventive concept overcomes the problems associated with known methods of forming products having cast-in components in practical and cost-effective manner.

One skilled in the art will readily recognize from such discussion, and from the accompanying drawings and claims that various changes, modifications and variations can be made therein without departing from the true spirit and fair scope of the invention as defined by the following claims.

What is claimed is:

1. A method of forming a cast part, the method comprising:

forming a part-forming mold having a lower portion and an upper portion;

placing a metal component in said lower portion, said metal component having a hollow area;

placing an insulating material in said hollow area and surrounding said metal component, said insulating material having a cavity formed therein;

melting a quantity of metal to provide a molten metal;

pouring a portion of said molten metal into said cavity;

placing said upper portion over said lower portion to form said mold, said upper portion being separate from said insulating material; and pouring a remainder of said molten metal into said mold.

2. The method of forming a cast part of claim 1 including identifying a selected temperature for said metal component and pouring the remainder of said molten metal into said mold after said metal component reaches said selected temperature.

3. The method of forming a cast part of claim 1 wherein said upper portion is placed over said lower portion after said portion of said molten metal is placed in said cavity of said insulating material.

4. The method of forming a cast part of claim 1 wherein said metal component is a cast iron metal component.

5. The method of forming a cast part of claim 1 wherein said metal component is a cylinder liner.

6. The method of forming a cast part of claim 1 wherein said insulating material is solidifiable sand.

7. The method of forming a cast part of claim 1 wherein said molten metal is aluminum.

8. A method of forming a cast part, the method comprising:

forming a mold having upper and lower portions;

forming a metal component, said metal component having a hollow area;

placing said metal component in said lower portion;

placing an insulating material having a cavity in said hollow area, said insulating material surrounding said metal component;

pouring molten metal into said cavity to heat said metal component;

placing said upper portion over said lower portion to form said mold, said upper portion being separate from said insulating material; and pouring molten metal into said mold.

9. The method of forming a cast part of claim 8 including identifying a selected temperature for said metal component and pouring said molten metal into said cavity to heat said metal component after said metal component reaches said selected temperature.

10. The method of forming a cast part of claim 8 wherein said upper portion is placed over said lower portion before said molten metal is poured into said cavity to heat said metal component.

11. The method of forming a cast part of claim 8 wherein said molten metal poured into said cavity and said molten metal poured into said mold are the same metal.

12. The method of forming a cast part of claim 8 wherein said metal component is a cast iron metal component.

13. The method of forming a cast part of claim 8 wherein said metal component is a cylinder liner.

14. The method of forming a cast part of claim 8 wherein said molten metal is aluminum.

15. A method of forming a cast part, the method comprising:

forming a mold having upper and lower portions;

placing a component having a hollow area in said lower portion;

placing an insulating material having a cavity in said area, said insulating material surrounding said component;

placing said upper portion over said lower portion to form a mold package, said upper portion being separate from said insulating material;

pouring a first portion of a molten metal into said cavity; and pouring a second portion of said molten metal into said mold substantially around said component.

16. The method of forming a cast part of claim 15 including identifying a selected temperature for said component and pouring said first portion of said molten metal into said cavity to heat said component after said component reaches said selected temperature.

17. The method of forming a cast part of claim 15 wherein said component is a metal component.

18. The method of forming a cast part of claim 17 wherein said metal component is a cast iron metal component.

19. The method of forming a cast part of claim 18 wherein said cast iron metal component is a cylinder liner.

20. The method of forming a cast part of claim 15 wherein said molten metal is aluminum.

* * * * *